US011657756B2

(12) United States Patent
Wang et al.

(10) Patent No.: US 11,657,756 B2
(45) Date of Patent: May 23, 2023

(54) DISPLAY PANEL AND DISPLAY APPARATUS

(71) Applicants: Chengdu BOE Optoelectronics Technology Co., Ltd., Chengdu (CN); BOE Technology Group Co., Ltd., Beijing (CN)

(72) Inventors: Miao Wang, Beijing (CN); Yunsheng Xiao, Beijing (CN); Yuqian Pang, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 113 days.

(21) Appl. No.: 17/426,369

(22) PCT Filed: Oct. 23, 2020

(86) PCT No.: PCT/CN2020/123408
§ 371 (c)(1),
(2) Date: Jul. 28, 2021

(87) PCT Pub. No.: WO2022/082773
PCT Pub. Date: Apr. 28, 2022

(65) Prior Publication Data
US 2022/0319408 A1 Oct. 6, 2022

(51) Int. Cl.
*G09G 3/3225* (2016.01)

(52) U.S. Cl.
CPC ... *G09G 3/3225* (2013.01); *G09G 2300/0413* (2013.01); *G09G 2300/0426* (2013.01);
(Continued)

(58) Field of Classification Search
CPC ..... G09G 3/3225; G09G 2300/0413; G09G 2300/0426; G09G 2300/0819;
(Continued)

(56) References Cited

U.S. PATENT DOCUMENTS 6,961,041 B2 11/2005 Iida et al.
10,490,119 B2 11/2019 Kim et al.
(Continued)

FOREIGN PATENT DOCUMENTS

CN 102956180 A 3/2013
CN 105448271 A 3/2016
(Continued)

*Primary Examiner* — Kenneth B Lee, Jr.
(74) *Attorney, Agent, or Firm* — ArentFox Schiff LLP; Michael Fainberg

(57) ABSTRACT

The present disclosure discloses a display panel and a display apparatus. The display panel includes a display region and a non-display region surrounding the display region. The display region includes: a plurality of sub-pixels disposed in an array, and each sub-pixel includes a pixel circuit and a light emitting device. A control terminal of anode reset transistor is electrically connected with a control terminal of reset transistors in the next row of sub-pixels. The non-display region includes: a row of dummy sub-pixels, the dummy sub-pixels correspond to columns of sub-pixels in one to one correspondence, each dummy sub-pixel includes a dummy pixel circuit and a dummy light emitting device, and the dummy light emitting device does not emit light. and a control terminal of the dummy anode reset transistor is electrically connected with a control terminal of reset transistor in a first row of sub-pixels correspondingly.

18 Claims, 11 Drawing Sheets

(52) U.S. Cl.
CPC ..... *G09G 2300/0819* (2013.01); *G09G 2300/0842* (2013.01); *G09G 2300/0861* (2013.01); *G09G 2320/0233* (2013.01); *G09G 2330/04* (2013.01)

(58) Field of Classification Search
CPC ... G09G 2300/0842; G09G 2300/0861; G09G 2320/0233; G09G 2330/04
See application file for complete search history.

(56) References Cited

U.S. PATENT DOCUMENTS

| | | | |
|---|---|---|---|
| 2013/0050157 | A1 | 2/2013 | Baek et al. |
| 2015/0262526 | A1 | 9/2015 | Park et al. |
| 2018/0190202 | A1 | 7/2018 | Kong |
| 2019/0164954 | A1 | 5/2019 | Yang et al. |
| 2020/0020266 | A1 | 1/2020 | Feng et al. |
| 2021/0151544 | A1* | 5/2021 | Kim ..... H01L 27/3262 |
| 2021/0201810 | A1 | 7/2021 | Feng et al. |

FOREIGN PATENT DOCUMENTS

| | | | |
|---|---|---|---|
| CN | 107993579 | A | 5/2018 |
| CN | 108257559 | A | 7/2018 |
| CN | 108766327 | A | 11/2018 |
| CN | 108877627 | A | 11/2018 |
| CN | 109935212 | A | 6/2019 |
| CN | 110223656 | A | 9/2019 |
| CN | 111445849 | A | 7/2020 |
| CN | 111540756 | A | 8/2020 |
| CN | 211350065 | U | 8/2020 |

* cited by examiner

DISPLAY PANEL AND DISPLAY APPARATUS

CROSS REFERENCE TO RELATED APPLICATIONS

This application is a National Stage of International Application No. PCT/CN2020/123408, filed on Oct. 23, 2020, the entire content of which is incorporated herein by reference.

FIELD

The present disclosure relates to the technical field of display, in particular to a display panel and a display apparatus.

BACKGROUND

Organic light emitting diodes (OLEDs) are one of the hotspots in the field of flat panel display research nowadays. Compared with liquid crystal displays (LCDs), OLED displays have the advantages of low energy consumption, low production cost, self-luminescence, wide viewing angles, fast response, etc. At present, the OLED displays have begun to replace traditional LCDs in the display fields such as mobile phones, tablet computers, and digital cameras.

SUMMARY

Embodiments of the present disclosure provide a display panel, including a display region and a non-display region surrounding the display region;

the display region includes:

a plurality of sub-pixels disposed in an array, each sub-pixel includes a pixel circuit and a light emitting device, and the pixel circuit is used to drive the light emitting device to emit light; the pixel circuit includes a drive transistor, an anode reset transistor, and a reset transistor; a first terminal of the anode reset transistor is electrically connected with an initialization signal line, a second terminal of the anode reset transistor is electrically connected with an anode of the light emitting device, and a cathode of the light emitting device is electrically connected with a first power terminal; a first terminal of the reset transistor is electrically connected with a gate of the drive transistor, and a second terminal of the reset transistor is electrically connected with the initialization signal line;

in each column of the sub-pixels, a control terminal of the anode reset transistor in a sub-pixel in a previous row is electrically connected with a control terminal of the reset transistor in a sub-pixel in a row next to the previous row;

the non-display region includes:

a row of dummy sub-pixels, the dummy sub-pixels corresponds to columns of the sub-pixels in one to one correspondence, each dummy sub-pixel includes a dummy pixel circuit and a dummy light emitting device, and the dummy light emitting device does not emit light; the dummy pixel circuit includes a dummy anode reset transistor, a first terminal of the dummy anode reset transistor is electrically connected with the initialization signal line, a second terminal of the dummy anode reset transistor is electrically connected with an anode of the dummy light emitting device, and a cathode of the dummy light emitting device is electrically connected with the first power terminal; and a control terminal of the dummy anode reset transistor is correspondingly electrically connected with the control terminal of the reset transistor in a respective one sub-pixel in a first row of the sub-pixels.

Optionally, in the display panel provided by the embodiments of the present disclosure, the dummy pixel circuit further includes: a dummy drive transistor, a dummy reset transistor, a first dummy light emitting control transistor and a second dummy light emitting control transistor;

a control terminal of the dummy reset transistor, a control terminal of the first dummy light emitting control transistor, and a control terminal of the second dummy light emitting control transistor are all electrically connected with a cut-off signal terminal;

a first terminal of the dummy reset transistor is electrically connected with a gate of the dummy drive transistor, and a second terminal of the dummy reset transistor is electrically connected with the initialization signal line;

a first terminal of the first dummy light emitting control transistor is electrically connected with second power terminal, and a second terminal of the first dummy light emitting control transistor is electrically connected with a first electrode of the dummy drive transistor; and a first terminal of the second dummy light emitting control transistor is electrically connected with a second electrode of the dummy drive transistor, and a second terminal of the second dummy light emitting control transistor is electrically connected with the anode of the dummy light emitting device.

Optionally, in the display panel provided by the embodiments of the present disclosure, the dummy reset transistor, the first dummy light emitting control transistor, and the second dummy light emitting control transistor are all P-type transistors, and the cut-off signal terminal are the second power terminal.

Optionally, the display panel provided by the embodiments of the present disclosure further includes a high-level voltage line and a low-level voltage line;

the dummy reset transistor, the first dummy light emitting control transistor, and the second dummy light emitting control transistor are all P-type transistors, and the cut-off signal terminal is electrically connected with the high-level voltage line.

Optionally, the display panel provided by the embodiments of the present disclosure further includes a plurality of reset signal lines, a plurality of scan signal lines, multiple initialization signal lines, and one dummy scan signal line; one row of sub-pixels corresponds to one of the plurality of scan signal lines, one of the plurality of reset signal lines, and one of the multiple initialization signal lines, and the dummy sub-pixels correspond to the dummy scan signal line and one of the multiple initialization signal lines;

the control terminal of the dummy anode reset transistor is electrically connected with the dummy scan signal line; and the control terminal of the reset transistor is electrically connected with the reset signal lines.

Optionally, in the display panel provided by the embodiments of the present disclosure, in each column of sub-pixels, the scan signal line corresponding to the previous row of sub-pixels is electrically connected with a reset signal line corresponding to the next row of sub-pixels; and the dummy scan signal line is electrically connected with a reset signal line corresponding to the first row of sub-pixels.

Optionally, in the display panel provided by the embodiments of the present disclosure, the display panel further includes a plurality of data signal lines; the pixel circuit further includes a data writing transistor, a first terminal of the data writing transistor is electrically connected with the data signal lines, a control terminal of the data writing transistor is electrically connected with the scan signal lines, a second terminal of the data writing transistor is electrically connected with a first electrode of the drive transistor, and one column of sub-pixels is electrically connected with one data signal line correspondingly; and the dummy pixel circuit further includes a dummy data writing transistor, a first terminal of the dummy data writing transistor is electrically connected with the data signal lines, a control terminal of the dummy data writing transistor is electrically connected with the dummy scan signal line, a second terminal of the dummy data writing transistor is electrically connected with the first electrode of the dummy drive transistor, and the dummy sub-pixel is electrically connected with a data signal line corresponding to a column where the dummy sub-pixel is located.

Optionally, in the display panel provided by the embodiments of the present disclosure, each dummy pixel circuit further includes a dummy threshold compensation transistor and a dummy storage capacitor; a first terminal of the dummy threshold compensation transistor is electrically connected with the gate of the dummy drive transistor, a control terminal of the dummy threshold compensation transistor is electrically connected with the control terminals of the dummy anode reset transistor, and a second terminal of the dummy threshold compensation transistor is electrically connected with the second electrode of the dummy drive transistor; a first terminal of the dummy storage capacitor is electrically connected with the second power terminal, and a second terminal of the dummy storage capacitor is electrically connected with the gate of the dummy drive transistor;

each pixel circuit further includes: a first light emitting control transistor, a second light emitting control transistor, a threshold compensation transistor and a storage capacitor;

a control terminal of the first light emitting control transistor is electrically connected with light emitting control terminal, a first terminal of the first light emitting control transistor is electrically connected with the second power terminals, and a second terminal of the first light emitting control transistor is electrically connected with the first electrode of the drive transistor;

a control terminal of the second light emitting control transistor is electrically connected with the light emitting control terminal, a first terminal of the second light emitting control transistor is electrically connected with the second electrode of the drive transistor, and a second terminal of the second light emitting control transistor is electrically connected with the anode of the light emitting device;

a first terminal of the threshold compensation transistor is electrically connected with the gate of the drive transistor, a control terminal of the threshold compensation transistor is electrically connected with the control terminal of the anode reset transistor, and a second terminal of the threshold compensation transistor is electrically connected with the second electrode of the drive transistor; and a first terminal of the storage capacitor is electrically connected with the second power terminal, and second terminal of the storage capacitor is electrically connected with the gate of the drive transistor.

Optionally, in the display panel provided by the embodiments of the present disclosure, all the transistors are P-type transistors.

Correspondingly, an embodiment of the present disclosure further provides a display apparatus, including the display panel provided by the embodiment of the present disclosure.

DETAILED DESCRIPTION OF THE EMBODIMENTS

Figure 1:
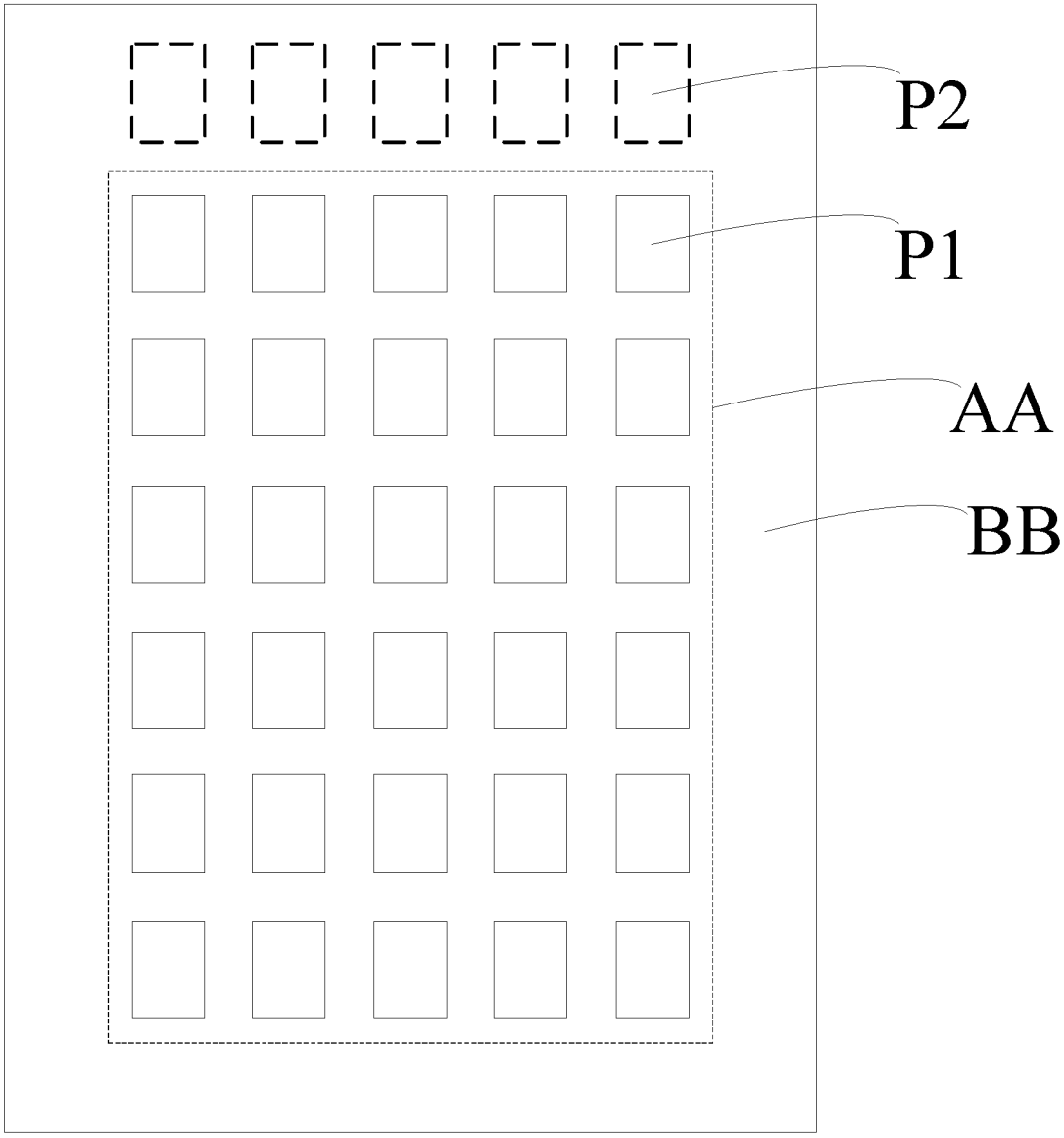
FIG. 1 is a schematic top view of a display panel provided by an embodiment of the present disclosure.

In order to make the objectives, technical solutions, and advantages of the embodiments of the present disclosure clearer, the technical solutions of the embodiments of the present disclosure will be clearly and fully described in combination with the accompanying drawings of the embodiments of the present disclosure. It is apparent that the described embodiments are some, but not all, embodiments of the present disclosure. Also, embodiments and features in the embodiments of the present disclosure may be combined with one another without conflict. Based on the described embodiments of the present disclosure, all other embodiments attainable by one of ordinary skilled in the art without involving any inventive effort are within the scope of the present disclosure.

Unless otherwise defined, the technical terms or scientific terms used in the present disclosure shall have the usual meanings understood by those with ordinary skills in the field to which the present disclosure belongs. "Comprise" or "include" or other similar words mean that the element or item appearing before the word covers elements or items listed after the word and their equivalents, but does not exclude other elements or items. "Connecting" or "connected" or other similar words are not limited to physical or mechanical connections, but may include electrical connections, whether direct or indirect. The terms "inner, outer, upper, lower", and the like are used merely to denote a relative positional relationship that may change accordingly when the absolute position of the object being described changes.

It should be noted that the dimensions and shapes of the various figures in the drawings are not to scale and are intended to be merely illustrative of the present disclosure. The same or similar reference numerals refer to the same or similar elements or elements having the same or similar functions throughout.

A pixel circuit is the core technical content of an OLED display panel and has important research significance. Generally, in order to meet the requirements for the reset of the pixel circuits and the uniform light emission of pixels, the pixel circuits usually need to be connected with multiple signal lines because there is a close relationship between the light emitting brightness of an OLED display screen and signal line loads. A display panel generally includes a plurality of sub-pixels disposed in an array. Each sub-pixel includes a pixel circuit and a light emitting device. Commonly used pixel circuits at present are each of a 7T1C structure, namely, having seven thin film transistors and one storage capacitor. Each pixel circuit is generally connected with a scan signal line, a reset signal line, an initialization signal line, a data signal line, a light emitting control signal line, etc. A signal on each scan signal line is generally given by a gate driver on array (GOA) circuit. Each GOA includes a plurality of shift registers connected in cascade, and the output terminal of each shift register is electrically connected with the scan signal line of a corresponding row to realize row-by-row scan. As for reset signals, in the related design, the reset signal of a first row of pixels in a display region is output by the GOA of the 0th level separately, that is, the reset signal line of the first row of pixels is connected with the output terminal of the GOA of the 0th level, and in the pixels of the second row and below, each reset signal line is connected with the scan signal line of the previous row, which causes a load of the reset signal line of the first row of pixels to be inconsistent with loads of the reset signal lines of other rows, resulting in non-uniform display brightness of the display panel. Therefore, it is necessary to perform load compensation for the load of the reset signal line of the first row of pixels.

Figure 2:
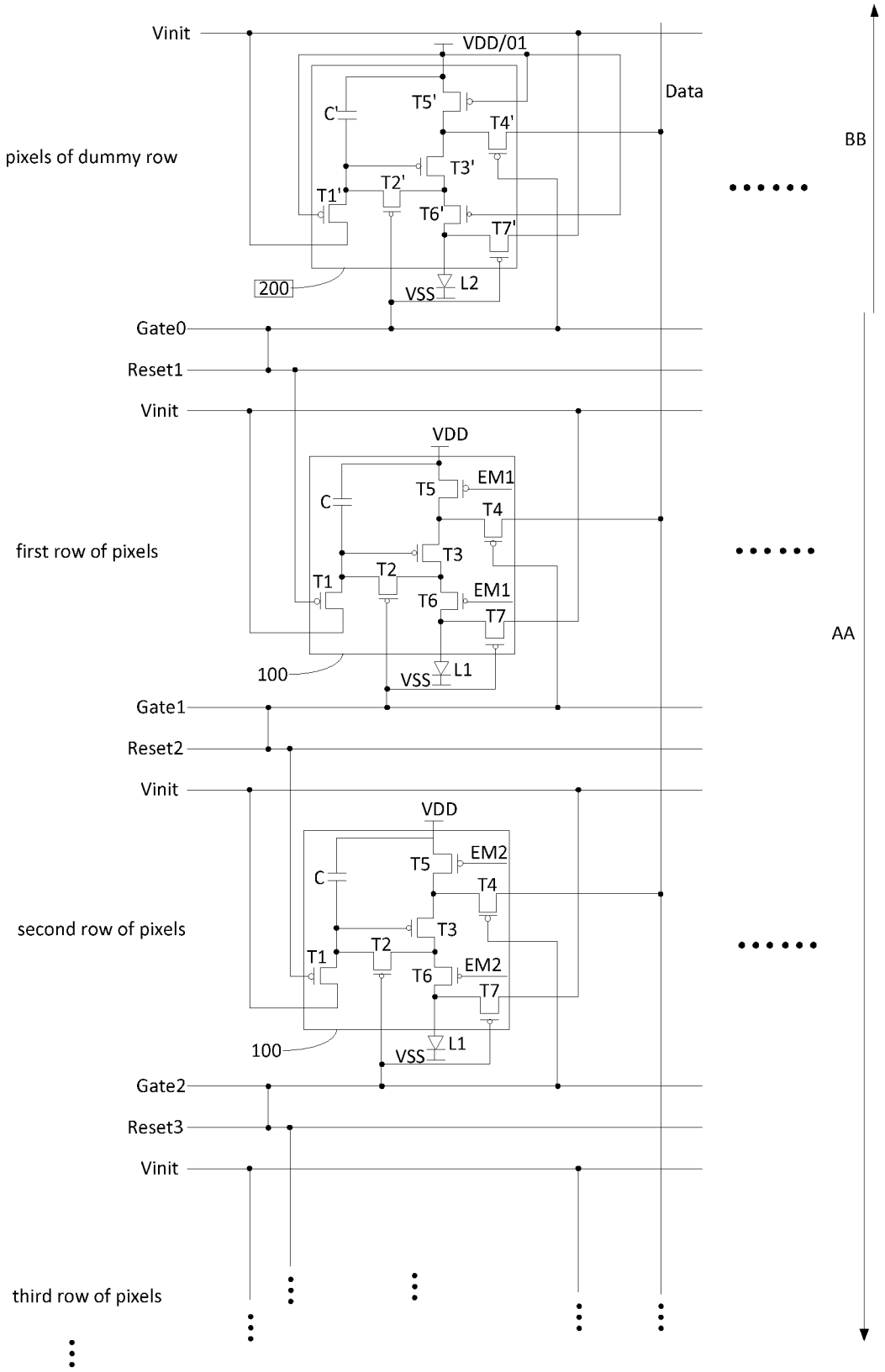
FIG. 2 is a schematic structural diagram corresponding to pixel circuits and a dummy pixel circuit in the display panel shown in FIG. 1.
Figure 3:
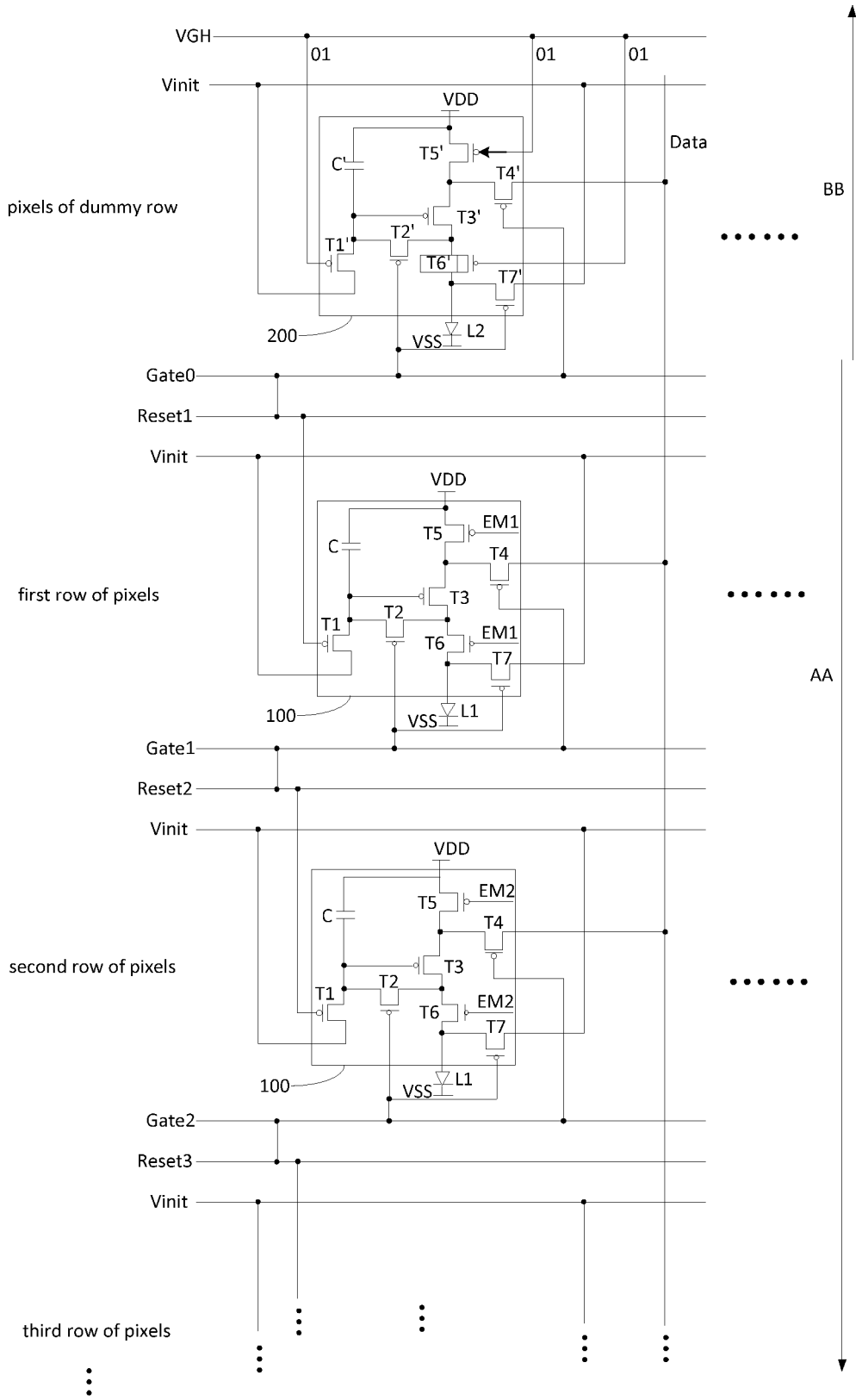
FIG. 3 is another schematic structural diagram corresponding to the pixel circuits and the dummy pixel circuit in the display panel shown in FIG. 1.

In view of this, Embodiments of the present disclosure provide a display panel. As shown in FIGS. 1 to 3, the display panel includes a display region AA and a non-display region BB surrounding the display region AA.

The display region AA includes: a plurality of sub-pixels P1 disposed in an array. Each sub-pixel P1 includes a pixel circuit 100 and a light emitting device L1. The pixel circuit 100 is used to drive the light emitting device L1 to emit light. The pixel circuit 100 includes a drive transistor T3, an anode reset transistor T7, and a reset transistor T1. A first terminal of the anode reset transistor T7 is electrically connected with initialization signal line Vinit, a second terminal of the anode reset transistor T7 is electrically connected with an anode of the light emitting device L1, and a cathode of the light emitting device L1 is electrically connected with first power terminal VSS. A first terminal of the reset transistor T1 is electrically connected with a gate of the drive transistor T3, and a second terminal of the reset transistor T1 is electrically connected with the initialization signal line Vinit.

In each column of the sub-pixels P1, a control terminal of the anode reset transistor T7 in a sub-pixel P1 in a previous row is electrically connected with a control terminal of the reset transistor T1 in a sub-pixel in a sub-pixel P1 in a row next to the previous row.

The non-display region BB includes:

a row of dummy sub-pixels P2. The dummy sub-pixels P2 corresponds to columns of the sub-pixels P1 in one to one correspondence. Each dummy sub-pixel P2 includes a dummy pixel circuit 200 and a dummy light emitting device L2, and the dummy light emitting devices L2 do not emit light. The dummy pixel circuit 200 includes a dummy anode reset transistor T7', a first terminal of the dummy anode reset transistor T7' is electrically connected with the initialization signal line Vinit, and a second terminal of the dummy anode reset transistor T7' is electrically connected with an anode of the dummy light emitting device L2. A cathode of the dummy light emitting device L2 is electrically connected with the first power terminal VSS.

A control terminal of the dummy anode reset transistor T7' is electrically connected with a control terminal of reset transistor T1 in a respective one sub-pixel in a first row of the sub-pixels P1.

In the display panel provided by the embodiments of the present disclosure, the control terminals of the anode reset transistors T7 in the sub-pixels P1 in a previous row are electrically connected with the control terminals of the reset transistors T1 in the sub-pixels P1 in a row next to the previous row, one row of dummy sub-pixels P2 is disposed in the non-display region BB, and the control terminals of the dummy anode reset transistors T7' of the dummy sub-pixels P2 are correspondingly electrically connected with the control terminals of the reset transistors T1 in the first row of sub-pixels P1, so that signals received by the control terminals of the reset transistors T1 of the first row of sub-pixels P1 have the same source as signals received by the control terminals of the reset transistors T1 in the other rows of sub-pixels P1, a load of a reset signal line connected with the reset transistors T1 in the first row is consistent with loads of reset signal lines connected with the reset transistors T1 of other rows, and thus the uniformity of the display brightness of the display panel may be improved.

Accordingly, each light emitting device may include at least one of an organic light emitting diode (OLED) and a quantum dot light emitting diode (QLED).

Accordingly, in the embodiments of the present disclosure, the first row of sub-pixels, the second row of sub-pixels, and the row of dummy sub-pixels located above the first row of sub-pixels are taken as examples for description in FIGS. 2 and 3. The connection relationship of the third row of sub-pixels and the connection relationship of other rows of sub-pixels are the same as the connection relationship of the second row of sub-pixels.

In specific implementation, in the display panel provided by the embodiments of the present disclosure, as shown in FIGS. 2 and 3, the dummy pixel circuit 200 further includes: a dummy drive transistor T3', a dummy reset transistor T1', a first dummy light emitting control transistor T5' and a second dummy light emitting control transistor T6'; and a control terminal of the dummy reset transistor T1', a control terminal of the first dummy light emitting control transistor T5', and a control terminal of the second dummy light emitting control transistor T6' are all electrically connected with a cut-off signal terminal 01. The dummy reset transistor T1', the first dummy light emitting control transistor T5' and the second dummy light emitting control transistor T6' may be always in an off state through a signal of the cut-off signal terminal 01, so that the dummy light emitting device L2 does not emit light and does not affect the light emitting effect of the display region AA.

A first terminal of the dummy reset transistor T1' is electrically connected with a gate of the dummy drive transistor T3', and a second terminal of the dummy reset transistor T1' is electrically connected with the initialization signal lines Vinit.

A first terminal of the first dummy light emitting control transistor T5' is electrically connected with a second power terminal VDD, and a second terminal of the first dummy light emitting control transistor T5' is electrically connected with a first electrode of the dummy drive transistor T3'.

A first terminal of the second dummy light emitting control transistor T6' is electrically connected with a second electrode of the dummy drive transistor T3', and a second terminal of the second dummy light emitting control transistor T6' is electrically connected with the anode of the dummy light emitting device L2.

In specific implementation, in the display panel provided by the embodiments of the present disclosure, as shown in FIG. 2, the dummy reset transistor T1', the first dummy light emitting control transistor T5', and the second dummy light emitting control transistor T6' may all be P-type transistors. Since the P-type transistors are turned off under the action of a high potential, and a voltage of the second power terminal VDD is a high voltage, the cut-off signal terminal 01 may be the second power terminal VDD, that is, the control terminal of the dummy reset transistor T1', the control terminal of the first dummy light emitting control transistor T5' and the control terminal of the second dummy light emitting control transistor T6' are all electrically connected with the second power terminal VDD. Under the control of the second power terminal VDD, the dummy reset transistor T1', the first dummy light emitting control transistor T5' and the second dummy light emitting control transistor T6' are always in the off state, so as to ensure that the dummy light emitting device L2 does not emit light.

In specific implementation, the display panel provided by the embodiments of the present disclosure, as shown in FIG. 3, further includes a high-level voltage line VGH.

As shown in FIG. 3, a dummy reset transistor T1', a first dummy light emitting control transistor T5', and a second dummy light emitting control transistor T6' may all be P-type transistors. Since the P-type transistors are turned off under the action of a high potential, and a voltage of a VGH is much higher than the voltage of a VDD, by electrically connecting a cut-off signal terminal 01 with the high-level voltage line VGH, it can be better ensured that the dummy reset transistor T1', the first dummy light emitting control transistor T5' and the second dummy light emitting control transistor T6' are always in the off state, so as to further ensure that a dummy light emitting device L2 does not emit light.

It should be noted that the display panel generally includes an anti-static circuit structure, and the high-level voltage line VGH is electrically connected with the anti-static circuit structure. By electrically connecting the control terminal of the dummy reset transistor T1', the control terminal of the first dummy light emitting control transistor T5' and the control terminal of the second dummy light emitting control transistor T6' with the high-level voltage line VGH, it can be ensured that the dummy reset transistor T1', the first dummy light emitting control transistor T5' and the second dummy light emitting control transistor T6' are always in the off state.

In specific implementation, the display panel provided by the embodiments of the present disclosure, as shown in FIGS. 2 and 3, further includes a plurality of reset signal lines (Reset1, Reset2, Reset3 . . . ), a plurality of scan signal lines (Gate1, Gate2 . . . ), the multiple initialization signal lines Vinit and a dummy scan signal line Gate0. One row of sub-pixels P1, for example, the first row of sub-pixels corresponds to one scan signal line Gate1, one reset signal line Reset1, and one initialization signal line Vinit, and the dummy sub-pixels P2 correspond to one dummy scan signal line Gate0 and one initialization signal line Vinit.

The control terminals of the dummy anode reset transistors T7' are electrically connected with the dummy scan signal line Gate0.

The control terminals of the reset transistors T1 in the first row are electrically connected with the reset signal line Reset1.

In specific implementation, in the display panel provided by the embodiments of the present disclosure, as shown in FIGS. 2 and 3, in each column of sub-pixels P1, the scan signal line corresponding to the previous row of sub-pixels is electrically connected with the reset signal line corresponding to the next row of sub-pixels. For example, the scan signal line Gate1 corresponding to the first row of sub-pixels P1 is electrically connected with the reset signal line Reset2 corresponding to the second row of sub-pixels P1, the scan signal line Gate2 corresponding to the second row of sub-pixels P1 is electrically connected with the reset signal line Reset3 corresponding to the third row of sub-pixels P1, the scan signal line Gate3 corresponding to the third row of sub-pixels P1 is electrically connected with the reset signal line Reset4 corresponding to the fourth row of sub-pixels P1, and so on.

The dummy scan signal line Gate0 is electrically connected with the reset signal line Reset1 corresponding to the first row of sub-pixels P1, so that the reset signal line Reset1 corresponding to the first row of sub-pixels P1 is given by the dummy scan signal line Gate0 of the previous row. Signals of the dummy scan signal line Gate0 and the scan signal lines (Gate1, Gate2 . . . ) are all output by the GOA circuit. Therefore, reset signals of the control terminals of the reset transistors T1 in all rows of sub-pixels in the display region AA have the same source, thereby ensuring the uniformity of the display brightness of the display panel.

In specific implementation, in the display panel provided by the embodiments of the present disclosure, as shown in FIGS. 2 and 3, the display panel further includes a plurality of data signal lines Data. Each pixel circuit 100 further includes a data writing transistor T4. A first terminal of the data writing transistor T4 is electrically connected with the data signal line Data. A control terminal of the data writing transistor T4 is electrically connected with the scan signal line, for example, the control terminals of the data writing transistors T4 in the first row of sub-pixels are electrically connected with the scan signal line Gate1. A second terminal of the data writing transistor T4 is electrically connected with a first electrode of the drive transistor T3. One column of sub-pixels P1 is correspondingly electrically connected with one data signal line Data.

The dummy pixel circuit 200 further includes a dummy data writing transistor T4'. A first terminal of the dummy data writing transistor T4' is electrically connected with the data signal line Data which corresponding to a column where the dummy data writing transistor T4' is located. A control terminal of the dummy data writing transistor T4' is electrically connected with the dummy scan signal line Gate0 which corresponding to a row where the dummy data writing transistor T4' is located. A second terminal of the dummy data writing transistor T4' is electrically connected with the first electrode of the dummy drive transistor T3'. Each dummy sub-pixel P2 is electrically connected with the data signal line Data of a corresponding column, that is, the dummy sub-pixel is electrically connected with a data signal line corresponding to a column where the dummy sub-pixel is located.

In specific implementation, in the display panel provided by the embodiments of the present disclosure, as shown in FIGS. 2 and 3, the dummy pixel circuit 200 further includes a dummy threshold compensation transistor T2' and a dummy storage capacitor C'. A first terminal of the dummy threshold compensation transistor T2 is electrically connected with the gate of the dummy drive transistor T3', a control terminal of the dummy threshold compensation transistor T2' is electrically connected with the control terminal of the dummy anode reset transistor T7', and a second terminal of the dummy threshold compensation transistor T2' is electrically connected with the second electrode of the dummy drive transistor T3'. A first terminal of the dummy storage capacitor C' is electrically connected with the second power terminal VDD, and a second terminal of the dummy storage capacitor C' is electrically connected with the gate of the dummy drive transistor T3'.

The pixel circuit 100 further includes: a first light emitting control transistor T5, a second light emitting control transistor T6, a threshold compensation transistor T2 and a storage capacitor C.

A control terminal of each first light emitting control transistor T5 is electrically connected with a light emitting control terminal EM. For example, the control terminals of the first light emitting control transistors T5 in the first row of sub-pixels P1 are electrically connected with the light emitting control terminals EM1, the control terminals of the first light emitting control transistors T5 in the second row of sub-pixels P1 are electrically connected with the light emitting control terminals EM2, and so on. First terminals of the first light emitting control transistors T5 are electrically connected with second power terminals VDD. Second terminals of the first light emitting control transistors T5 are electrically connected with the first electrodes of the drive transistors T3.

A control terminal of each second light emitting control transistor T6 is electrically connected with a light emitting control terminal EM. For example, the control terminals of the second light emitting control transistors T6 in the first row of sub-pixels P1 are electrically connected with the light emitting control terminals EM1, the control terminals of the second light emitting control transistors T6 in the second row of sub-pixels P1 are electrically connected with the light emitting control terminals EM2, and so on. First terminals of the second light emitting control transistors T6 are electrically connected with second electrodes of the drive transistors T3. Second terminals of the second light emitting control transistors T6 are electrically connected with the anodes of the light emitting devices L1.

A first terminal of the threshold compensation transistors T2 is electrically connected with the gate of the drive transistor T3. A control terminal of the threshold compensation transistors T2 is electrically connected with the control terminal of the anode reset transistor T7. A second terminal of the threshold compensation transistor T2 is electrically connected with the second electrode of the drive transistor T3.

a first terminal of the storage capacitor C is electrically connected with the second power terminal VDD, and a second terminal of the storage capacitor C is electrically connected with the gate of the drive transistor T3.

In specific implementation, in order to unify the manufacturing process, in the display panel provided by the embodiment of the present disclosure, as shown in FIGS. 2 and 3, all the transistors may be P-type transistors.

Accordingly, in the display panel provided by the embodiments of the present disclosure, the P-type transistors are connected under the action of a low-level signal, and disconnected under the action of a high-level signal.

Accordingly, in the display panel provided by the embodiments of the present disclosure, the transistors may be thin film transistors (TFT), or metal oxide semiconductor (MOS) field effect transistors, which are not limited here. According to the different types of the transistors and different signals of gates of the transistors, the control terminal of each transistor is used as the gate, and first terminals of switching transistors may be used as sources and second terminals may be used as drains, alternatively, the first terminals of the switching transistors may be used as the drains and the second terminals may be used as the sources, which are not specifically distinguished here.

Figure 4:
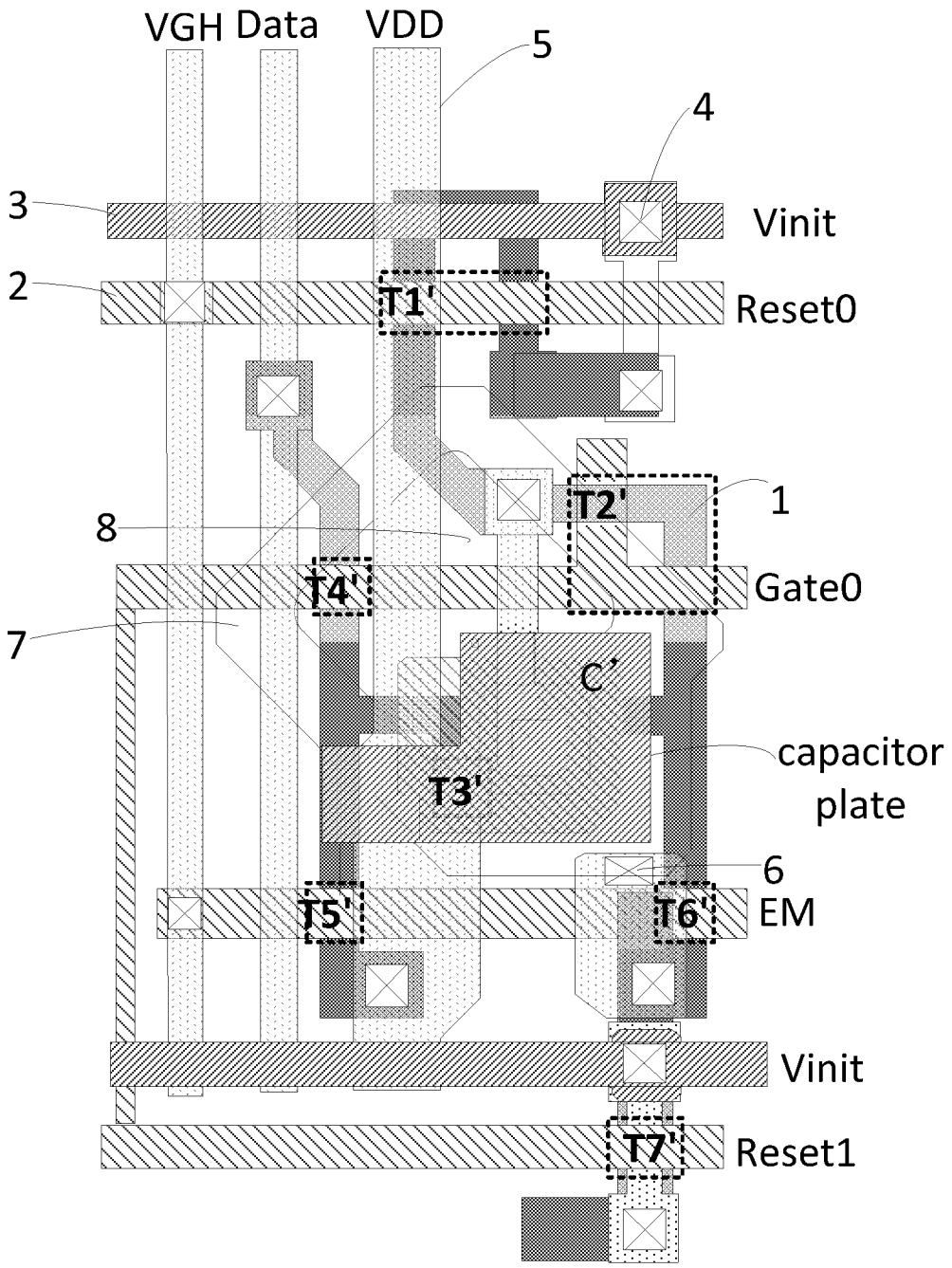
FIG. 4 is a schematic top view of a dummy sub-pixel region in a display panel provided by an embodiment of the present disclosure.

In some embodiments, as shown in FIG. 4, FIG. 4 is the layout structure of the 7T1C dummy pixel circuit in one dummy sub-pixel corresponding to FIG. 3. In the manufacturing process of the 7T1C dummy pixel circuit, an active layer 1, a first metal layer 2, a second metal layer 3, a first insulating layer 4, a third metal layer 5, a second insulating layer 6, an anode 7, a pixel defining layer 8 and other patterns need to be sequentially fabricated on a base substrate (not shown). The first metal layer 2 includes a scan signal line Gate0, a light emitting control signal line EM, and plates of a dummy storage capacitors C'. The second metal layer 3 includes data signal lines Data, a high-level voltage line VGH and a VDD power line. The third metal layer 5 includes an initialization signal line Vinit and another plates of the dummy storage capacitors C' electrically connected with second power terminals VDD. an extension direction of the initialization signal line Vinit are same as an extension direction of the light emitting control signal line EM, and the extension directions of the VDD power line and the light emitting control signal line EM are crossed. The schematic top views of the film layers in FIG. 4 are shown in FIGS. 5A to 5H, respectively. Corresponding to the structure shown in FIG. 3, in FIG. 4, a gate line Gate0 of a dummy row is connected with a first reset signal line Reset1 of the first row of sub-pixels, so as to realize that the reset signal of the first row of sub-pixels and the reset signals of other rows of sub-pixels are all from a signal on a gate line electrically connected with the previous row of pixels, and the Reset0 and EM of the dummy sub-pixels are connected with the VGH, so as to control T1', T5' and T6' to be always in the off state.

Figure 5A:
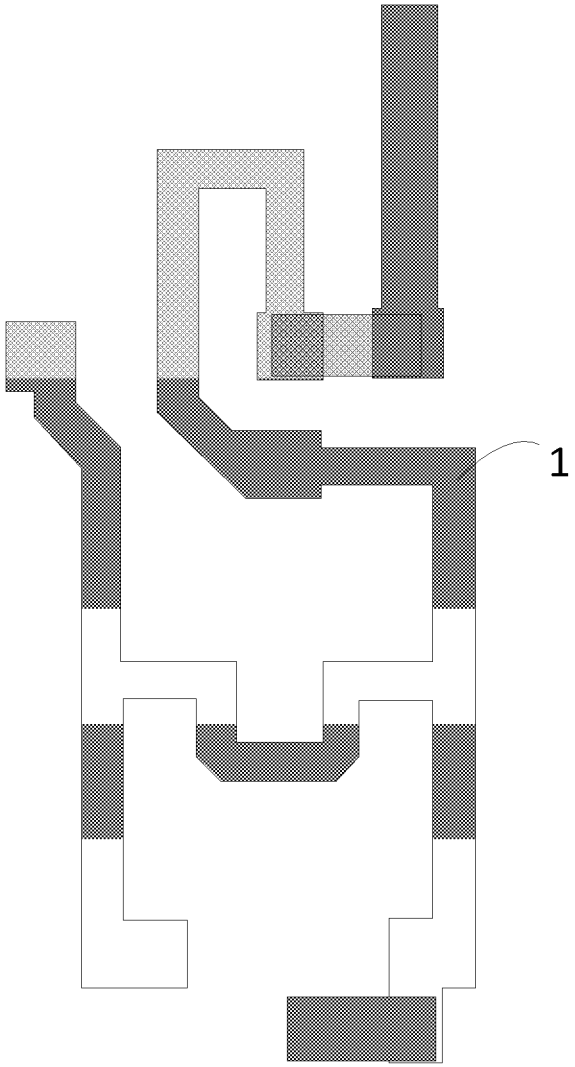
FIGS. 5A-5H are schematic top views of film layers corresponding to FIG. 4.
Figure 5B:
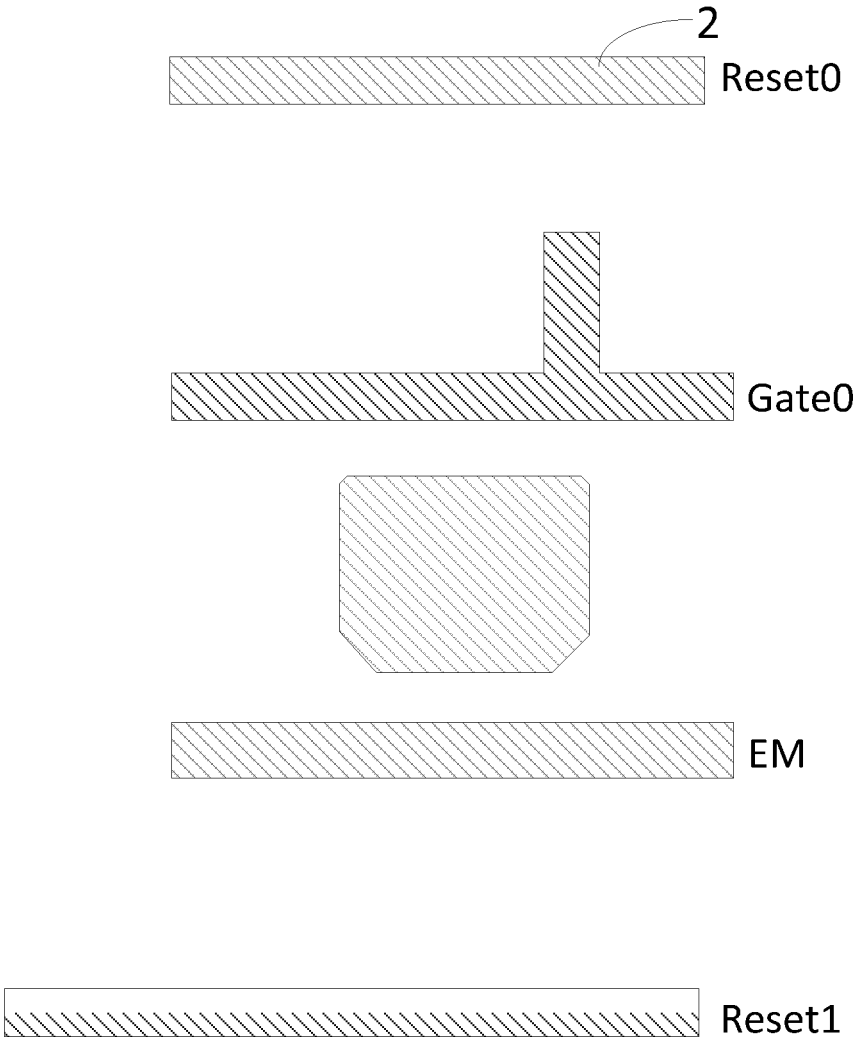
Figure 5C:
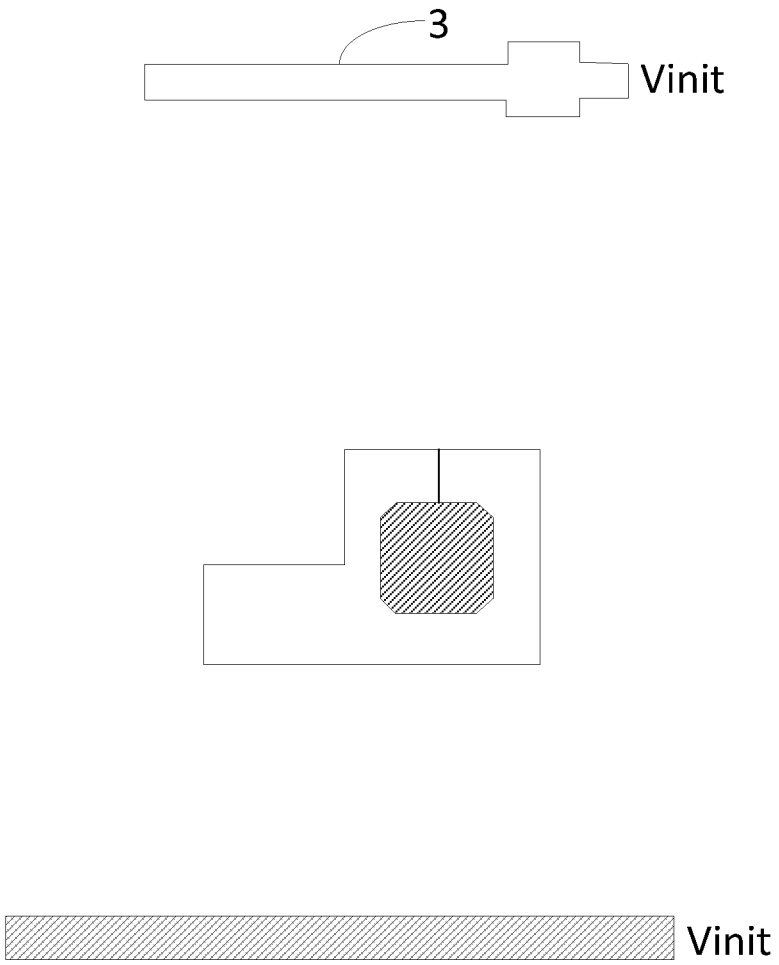
Figure 5D:
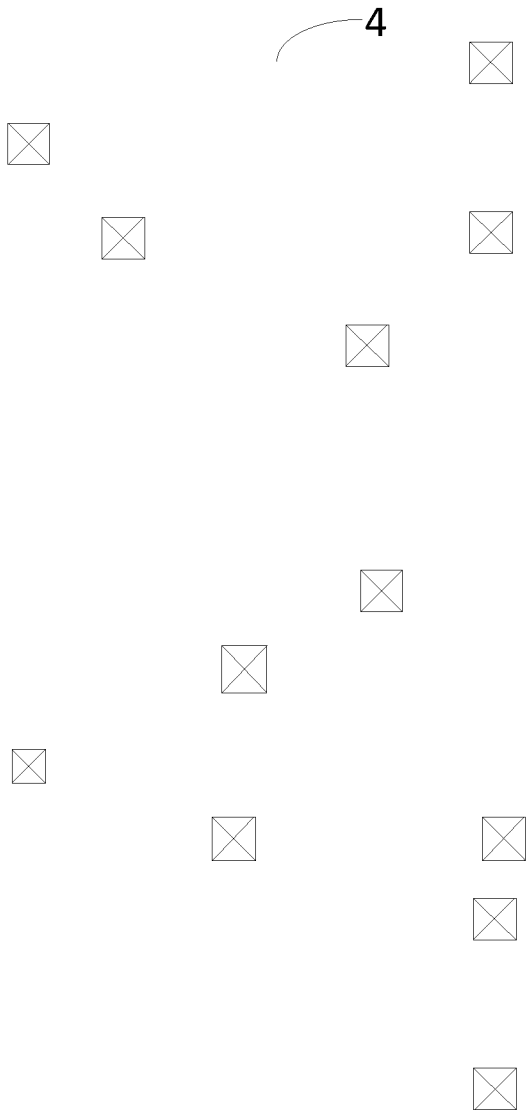
Figure 5E:
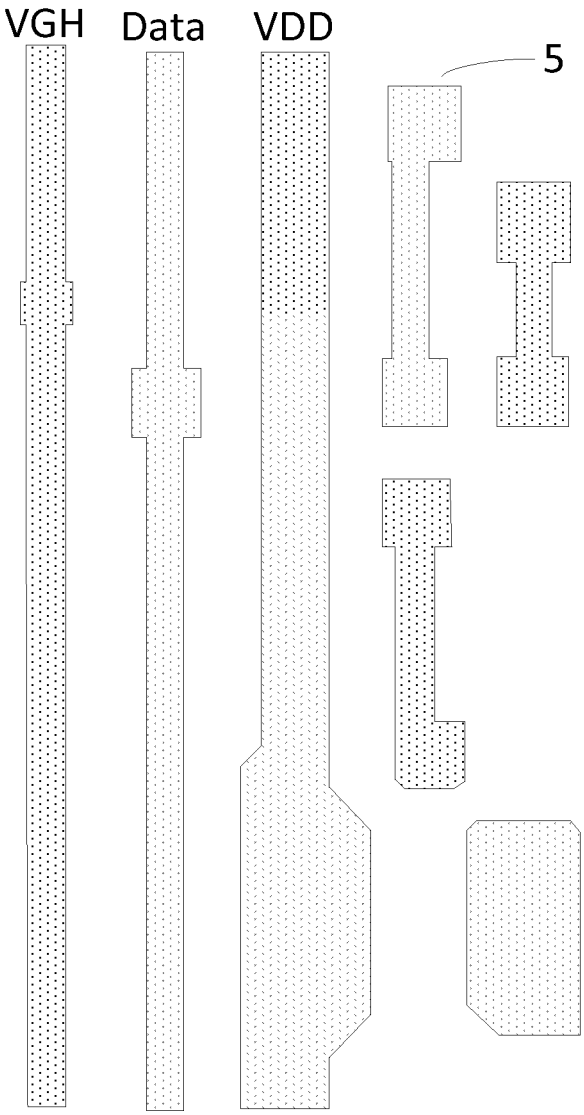
Figure 5F:
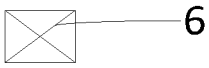
Figure 5G:
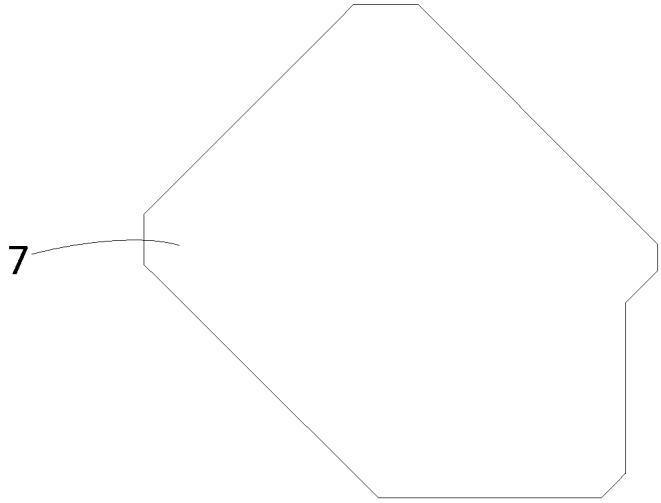
Figure 5H:
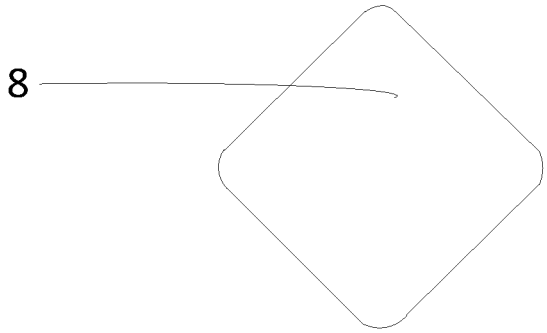

It should be noted that FIG. 5D illustrates a via region of the first insulating layer 4, FIG. 5F illustrates a via region of the second insulating layer 6, and FIG. 5H illustrates an opening region of the pixel defining layer 8.

It should be noted that FIGS. 5A to 5H only illustrate the schematic top views of the main film layers in each dummy sub-pixel region, though each dummy sub-pixel region further includes a buffer layer, other insulating layers and other film structures.

In specific implementation, the display panel provided by the embodiments of the present disclosure is an organic light emitting display panel.

Based on the same disclosure concept, an embodiment of the present disclosure also provides a display apparatus, including the display panel provided by the embodiments of the present disclosure. The principle by which the display apparatus solves the problem is similar to that of an array substrate, and therefore the implementation of the display apparatus may be referred to the implementation of the array substrate, which will not be repeated here.

In specific implementation, the display apparatus provided by the embodiments of the present disclosure may be a full-screen display apparatus, or a flexible display apparatus, etc., which is not limited here.

Figure 6:
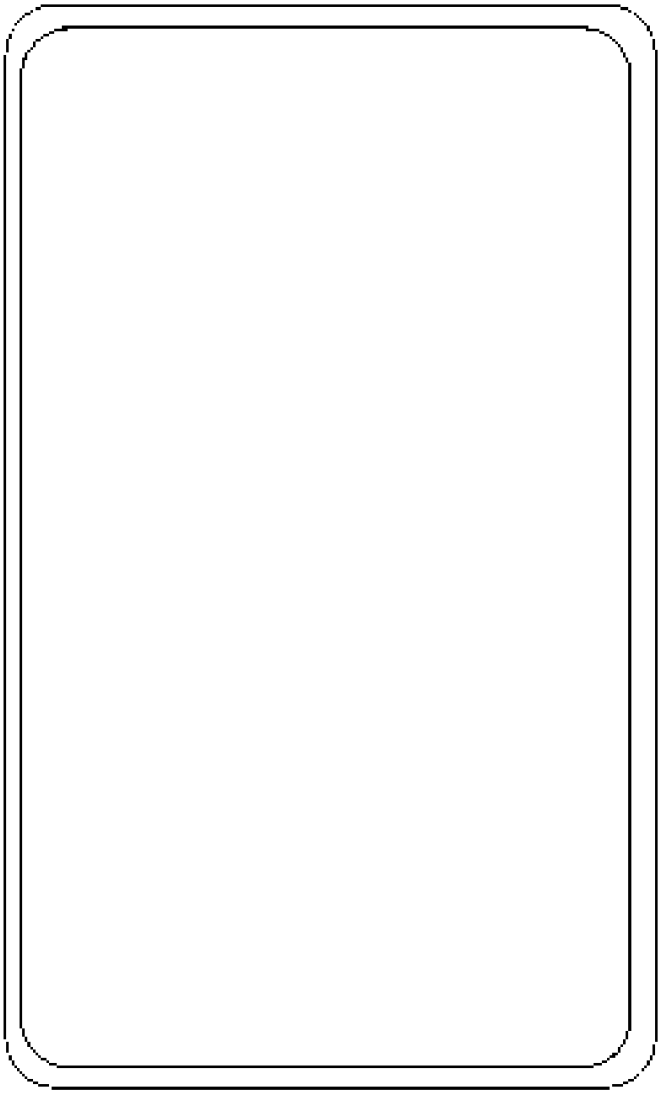
FIG. 6 is a schematic structural diagram of a display apparatus provided by an embodiment of the present disclosure.

In specific implementation, the display apparatus provided by the embodiments of the present disclosure may be a full-screen mobile phone as shown in FIG. 6. Of course, the display apparatus provided by the embodiments of the present disclosure may also be any product or component with a display function, such as a tablet computer, a television, a displayer, a notebook computer, a digital photo frame and a navigator. Other essential components of the display apparatus will be apparent to those ordinarily skilled in the art and are not repeated here, nor should they be construed as limiting the present disclosure.

In the display panel provided by the embodiments of the present disclosure, the control terminals of the anode reset transistors in the previous row of sub-pixels are electrically connected with the control terminals of the reset transistors in the next row of sub-pixels, one row of dummy sub-pixels is disposed in the non-display region and the control terminals of the dummy anode reset transistors of the row of dummy sub-pixels are electrically connected with the control terminals of the reset transistors in the first row of sub-pixels, so that the signals received by the control terminals of the reset transistors of the first row of sub-pixels have the same source as the signals received by the reset transistors in other rows of sub-pixels, the load of the reset signal line connected with the reset transistors of the first row is coincident with the loads of the reset signal lines connected with the reset transistors of the other rows, and thus the uniformity of the display brightness of the display panel may be improved.

Although the preferred embodiments of the present disclosure have been described, additional variations and modifications can be made to these embodiments by those skilled in the art once the basic inventive concept is known. Therefore, it is intended that the appended claims be interpreted as including the preferred embodiments and all alterations and modifications that fall within the scope of the disclosure.

It will be apparent to those skilled in the art that various modifications and variations can be made in the disclosed embodiments without departing from the spirit or scope of the disclosed embodiments. Thus, it is intended that the present disclosure cover the modifications and variations of the disclosure provided they come within the scope of the appended claims and their equivalents.

What is claimed is:

1. A display panel, comprising:

a display region; and a non-display region surrounding the display region, wherein the display region comprises:

a plurality of sub-pixels disposed in an array, each sub-pixel comprises a pixel circuit and a light emitting device, and the pixel circuit is used to drive the light emitting device to emit light; the pixel circuit comprises a drive transistor, an anode reset transistor, and a reset transistor, a first terminal of the anode reset transistor is electrically connected with an initialization signal line, a second terminal of the anode reset transistor is electrically connected with an anode of the light emitting device, and a cathode of the light emitting device is electrically connected with a first power terminal; a first terminal of the reset transistor is electrically connected with a gate of the drive transistor, and a second terminal of the reset transistor is electrically connected with the initialization signal line;

a control terminal of the anode reset transistor in one sub-pixel in one column of the sub-pixels is electrically connected with a control terminal of the reset transistor in another sub-pixel in the one column of the sub-pixels, wherein the one sub-pixel and the another sub-pixel are in adjacent rows of the sub-pixels;

the non-display region comprises:

a row of dummy sub-pixels, the dummy sub-pixels correspond to columns of the sub-pixels in one to one correspondence, each dummy sub-pixel comprises a dummy pixel circuit and a dummy light emitting device, and the dummy light emitting device does not emit light; the dummy pixel circuit comprises a dummy anode reset transistor, a first terminal of the dummy anode reset transistor is electrically connected with the initialization signal line, a second terminal of the dummy anode reset transistor is electrically connected with an anode of the dummy light emitting device, and a cathode of the dummy light emitting device is electrically connected with the first power terminal; and a control terminal of the dummy anode reset transistor is correspondingly electrically connected with the control terminal of the reset transistor in a respective one sub-pixel in a first row of the sub-pixels.

2. The display panel according to claim 1, wherein the dummy pixel circuit further comprises: a dummy drive transistor, a dummy reset transistor, a first dummy light emitting control transistor and a second dummy light emitting control transistor; wherein a control terminal of the dummy reset transistor, a control terminal of the first dummy light emitting control transistor, and a control terminal of the second dummy light emitting control transistor are all electrically connected with a cut-off signal terminal;

a first terminal of the dummy reset transistor is electrically connected with a gate of the dummy drive transistor, and a second terminal of the dummy reset transistor is electrically connected with the initialization signal line;

a first terminal of the first dummy light emitting control transistor is electrically connected with a second power terminal, and a second terminal of the first dummy light emitting control transistor is electrically connected with a first electrode of the dummy drive transistor; and a first terminal of the second dummy light emitting control transistor is electrically connected with a second electrode of the dummy drive transistor, and a second terminal of the second dummy light emitting control transistor is electrically connected with the anode of the dummy light emitting device.

3. The display panel according to claim 2, wherein the dummy reset transistor, the first dummy light emitting control transistor, and the second dummy light emitting control transistor are all P-type transistors, and the cut-off signal terminal is the second power terminal.

4. The display panel according to claim 2, further comprising a high-level voltage line;

wherein the dummy reset transistor, the first dummy light emitting control transistor, and the second dummy light emitting control transistor are all P-type transistors, and the cut-off signal terminal is electrically connected with the high-level voltage line.

5. The display panel according to claim 1, further comprising a plurality of reset signal lines, a plurality of scan signal lines, multiple initialization signal lines, and a dummy scan signal line;

wherein one row of sub-pixels corresponds to one of the plurality of scan signal lines, one of the plurality of reset signal line, and one of the multiple initialization signal lines, and the dummy sub-pixels correspond to the dummy scan signal line and one of the multiple initialization signal lines;

the control terminal of the dummy anode reset transistor is electrically connected with the dummy scan signal line; and the control terminal of the reset transistors is electrically connected with the reset signal lines.

6. The display panel according to claim 5, wherein in each column of sub-pixels, the scan signal line corresponding to the previous row of sub-pixels is electrically connected with a reset signal line corresponding to the next row of sub-pixels; and the dummy scan signal line is electrically connected with a reset signal line corresponding to the first row of sub-pixels.

7. The display panel according to claim 5, wherein the display panel further comprises a plurality of data signal lines;

the pixel circuit further comprises a data writing transistor, a first terminal of the data writing transistor is electrically connected with the data signal lines, a control terminal of the data writing transistor is electrically connected with the scan signal lines, a second terminal of the data writing transistor is electrically connected with a first electrode of the drive transistor, and one column of sub-pixels is electrically connected with one data signal line correspondingly; and the dummy pixel circuit further comprises a dummy data writing transistor, a first terminal of the dummy data writing transistor is electrically connected with the data signal lines, a control terminal of the dummy data writing transistor is electrically connected with the dummy scan signal line, a second terminal of the dummy data writing transistor is electrically connected with the first electrode of the dummy drive transistor, and the dummy sub-pixel is electrically connected with a data signal line corresponding to a column where the dummy sub-pixel is located.

8. The display panel according to claim 7, wherein each dummy pixel circuit further comprises a dummy threshold compensation transistor and a dummy storage capacitor;

wherein a first terminal of the dummy threshold compensation transistor is electrically connected with the gate of the dummy drive transistor, a control terminal of the dummy threshold compensation transistor is electrically connected with the control terminal of the dummy anode reset transistor, and a second terminal of the dummy threshold compensation transistor is electrically connected with the second electrode of the dummy drive transistor; a first terminal of the dummy storage capacitor is electrically connected with the second power terminal, and a second terminal of the dummy storage capacitor is electrically connected with the gate of the dummy drive transistor.

9. The display panel according to claim 8, wherein all the transistors are P-type transistors.

10. A display apparatus, comprising a display panel, wherein the display panel comprises:

a display region; and a non-display region surrounding the display region, wherein the display region comprises:

a plurality of sub-pixels disposed in an array, each sub-pixel comprises a pixel circuit and a light emitting device, and the pixel circuit is used to drive the light emitting device to emit light; the pixel circuit comprises a drive transistor, an anode reset transistor, and a reset transistor, a first terminal of the anode reset transistor is electrically connected with an initialization signal line, a second terminal of the anode reset transistor is electrically connected with an anode of the light emitting device, and a cathode of the light emitting device is electrically connected with a first power terminal; a first terminal of the reset transistor is electrically connected with a gate of the drive transistor, and a second terminal of the reset transistor is electrically connected with the initialization signal line;

a control terminal of the anode reset transistor in one sub-pixel in one column of the sub-pixels is electrically connected with a control terminal of the reset transistor in another sub-pixel in the one column of the sub-pixels, wherein the one sub-pixel and the another sub-pixel are in adjacent rows of the sub-pixels;

the non-display region comprises:

a row of dummy sub-pixels, the dummy sub-pixels correspond to columns of the sub-pixels in one to one correspondence, each dummy sub-pixel comprises a dummy pixel circuit and a dummy light emitting device, and the dummy light emitting device does not emit light; the dummy pixel circuit comprises a dummy anode reset transistor, a first terminal of the dummy anode reset transistor is electrically connected with the initialization signal line, a second terminal of the dummy anode reset transistor is electrically connected with an anode of the dummy light emitting device, and a cathode of the dummy light emitting device is electrically connected with the first power terminal; and a control terminal of the dummy anode reset transistor is correspondingly electrically connected with the control terminal of the reset transistor in a respective one sub-pixel in a first row of the sub-pixels.

11. The display panel according to claim 7, wherein the pixel circuit further comprises:

a first light emitting control transistor, a second light emitting control transistor, a threshold compensation transistor and a storage capacitor; wherein a control terminal of the first light emitting control transistor is electrically connected with a light emitting control terminal, a first terminal of the first light emitting control transistor is electrically connected with the second power terminal, and a second terminal of the first light emitting control transistor is electrically connected with the first electrode of the drive transistor;

a control terminal of the second light emitting control transistor is electrically connected with the light emitting control terminal, a first terminal of the second light emitting control transistor is electrically connected with the second electrode of the drive transistor, and a second terminal of the second light emitting control transistor is electrically connected with the anode of the light emitting device;

a first terminal of the threshold compensation transistor is electrically connected with the gate of the drive transistor, a control terminal of the threshold compensation transistor is electrically connected with the control terminal of the anode reset transistor, and a second terminal of the threshold compensation transistor is electrically connected with the second electrode of the drive transistor; and a first terminal of the storage capacitor is electrically connected with the second power terminal, and a second terminal of the storage capacitor is electrically connected with the gate of the drive transistor.

12. The display apparatus according to claim 10, wherein the dummy pixel circuit further comprises: a dummy drive transistor, a dummy reset transistor, a first dummy light emitting control transistor and a second dummy light emitting control transistor; wherein a control terminal of the dummy reset transistor, a control terminal of the first dummy light emitting control transistor, and a control terminal of the second dummy light emitting control transistor are all electrically connected with a cut-off signal terminal;

a first terminal of the dummy reset transistor is electrically connected with a gate of the dummy drive transistor, and a second terminal of the dummy reset transistor is electrically connected with the initialization signal line;

a first terminal of the first dummy light emitting control transistor is electrically connected with a second power terminal, and a second terminal of the first dummy light emitting control transistor is electrically connected with a first electrode of the dummy drive transistor; and a first terminal of the second dummy light emitting control transistor is electrically connected with a second electrode of the dummy drive transistor, and a second terminal of the second dummy light emitting control transistor is electrically connected with the anode of the dummy light emitting device.

13. The display apparatus according to claim 12, wherein the dummy reset transistor, the first dummy light emitting control transistor, and the second dummy light emitting control transistor are all P-type transistors, and the cut-off signal terminal is the second power terminal.

14. The display apparatus according to claim 10, the display panel further comprises a plurality of reset signal lines, a plurality of scan signal lines, multiple initialization signal lines, and a dummy scan signal line;

wherein one row of sub-pixels corresponds to one of the plurality of scan signal lines, one of the plurality of reset signal line, and one of the multiple initialization signal lines, and the dummy sub-pixels correspond to the dummy scan signal line and one of the multiple initialization signal lines;

the control terminal of the dummy anode reset transistor is electrically connected with the dummy scan signal line; and the control terminal of the reset transistors is electrically connected with the reset signal lines.

15. The display apparatus according to claim 14, wherein in each column of sub-pixels, the scan signal line corresponding to the previous row of sub-pixels is electrically connected with a reset signal line corresponding to the next row of sub-pixels; and the dummy scan signal line is electrically connected with a reset signal line corresponding to the first row of sub-pixels.

16. The display apparatus according to claim 14, wherein the display panel further comprises a plurality of data signal lines;

the pixel circuit further comprises a data writing transistor, a first terminal of the data writing transistor is electrically connected with the data signal lines, a control terminal of the data writing transistor is electrically connected with the scan signal lines, a second terminal of the data writing transistor is electrically connected with a first electrode of the drive transistor, and one column of sub-pixels is electrically connected with one data signal line correspondingly; and the dummy pixel circuit further comprises a dummy data writing transistor, a first terminal of the dummy data writing transistor is electrically connected with the data signal lines, a control terminal of the dummy data writing transistor is electrically connected with the dummy scan signal line, a second terminal of the dummy data writing transistor is electrically connected with the first electrode of the dummy drive transistor, and the dummy sub-pixel is electrically connected with a data signal line corresponding to a column where the dummy sub-pixel is located.

17. The display apparatus according to claim 16, wherein each dummy pixel circuit further comprises a dummy threshold compensation transistor and a dummy storage capacitor;

wherein a first terminal of the dummy threshold compensation transistor is electrically connected with the gate of the dummy drive transistor, a control terminal of the dummy threshold compensation transistor is electrically connected with the control terminal of the dummy anode reset transistor, and a second terminal of the dummy threshold compensation transistor is electrically connected with the second electrode of the dummy drive transistor; a first terminal of the dummy storage capacitor is electrically connected with the second power terminal, and a second terminal of the dummy storage capacitor is electrically connected with the gate of the dummy drive transistor.

18. The display apparatus according to claim 16, wherein the pixel circuit further comprises: a first light emitting control transistor, a second light emitting control transistor, a threshold compensation transistor and a storage capacitor; wherein a control terminal of the first light emitting control transistor is electrically connected with a light emitting control terminal, a first terminal of the first light emitting control transistor is electrically connected with the second power terminal, and a second terminal of the first light emitting control transistor is electrically connected with the first electrode of the drive transistor;

a control terminal of the second light emitting control transistor is electrically connected with the light emitting control terminal, a first terminal of the second light emitting control transistor is electrically connected with the second electrode of the drive transistor, and a second terminal of the second light emitting control transistor is electrically connected with the anode of the light emitting device;

a first terminal of the threshold compensation transistor is electrically connected with the gate of the drive transistor, a control terminal of the threshold compensation transistor is electrically connected with the control terminal of the anode reset transistor, and a second terminal of the threshold compensation transistor is electrically connected with the second electrode of the drive transistor; and a first terminal of the storage capacitor is electrically connected with the second power terminal, and a second terminal of the storage capacitor is electrically connected with the gate of the drive transistor.

* * * * *